US006068260A

United States Patent [19]

Dean

[11] Patent Number: 6,068,260

[45] Date of Patent: May 30, 2000

[54] LAWN TOSSING GAME WITH SAFETY HAND-TOSSED PROJECTILE IN COMBINATION WITH A MULTI-POCKETED TARGET

[76] Inventor: Robert O. Dean, 2255 Switzer Rd., Apt A-201, Gulfport, Miss. 39507-3835

[21] Appl. No.: 09/177,216

[22] Filed: Oct. 22, 1998

[51] Int. Cl.[7] ..... A63B 63/00; A63B 65/02

[52] U.S. Cl. ..... 273/400; 473/586

[58] Field of Search ..... 473/575, 576, 473/578, 579, 580, 581, 582, 583, 584, 585, 586, 614, 615, FOR 216, FOR 217, FOR 219, FOR 220, FOR 221, FOR 222, FOR 223; 273/404, 408, 398, 400

[56] References Cited

U.S. PATENT DOCUMENTS

| | | |
|---|---|---|
| 614,094 | 11/1898 | Farnum . |
| 715,249 | 12/1902 | Dunbar . |
| 922,717 | 5/1909 | Parker . |
| 1,072,954 | 9/1913 | Junn . |
| 1,261,957 | 4/1918 | Pewther . |
| 1,350,103 | 8/1920 | Lehmann . |
| 1,675,482 | 7/1928 | Boyet . |
| 3,454,278 | 7/1969 | Cooper . |
| 3,596,910 | 8/1971 | Rizzo . |
| 4,319,755 | 3/1982 | Orser, Sr. . |
| 4,488,728 | 12/1984 | Humphrey . |
| 4,887,822 | 12/1989 | Tsai . |
| 4,946,172 | 8/1990 | Wong . |
| 5,067,728 | 11/1991 | Dadbeh . |
| 5,098,109 | 3/1992 | Wayne . |
| 5,112,062 | 5/1992 | Pratt . |
| 5,207,434 | 5/1993 | Oudekerk . |
| 5,286,033 | 2/1994 | Wayne . |
| 5,951,419 | 9/1999 | Cameneti . |

FOREIGN PATENT DOCUMENTS

| | | |
|---|---|---|
| 779616 | 7/1957 | United Kingdom . |

*Primary Examiner*—Sebastiano Passaniti
*Attorney, Agent, or Firm*—Lisa D. Charouel

[57] ABSTRACT

A tossing game comprising a weighted hand-tossed projectile having a weighted safety head, a handle member projecting from a rear end of the weighted safety head and an airfoil stabilizing chute slidable coupled to the handle member and extendable immediately, upon release of said safety hand-tossed projectile, from a forward end of the handle member to a rear end of the handle member. A target adapted to receive the safety hand-tossed projectile. Preferably, the target includes a plurality of pockets in a row and column matric configuration.

32 Claims, 5 Drawing Sheets

LAWN TOSSING GAME WITH SAFETY HAND-TOSSED PROJECTILE IN COMBINATION WITH A MULTI-POCKETED TARGET

TECHNICAL FIELD

The present invention relates to lawn tossing games and, more particularly, to a lawn tossing game including a multi-pocketed target and a safety hand-tossed projectile which eliminates rear end fins without compromising the aerodynamic stability thereof.

BACKGROUND OF THE INVENTION

Lawn tossing games played by families or groups of people are very popular. Horse shoes and lawn darts are among such lawn tossing games. However, lawn darts were banned because children on occasion were accidentally struck by the pointed end of the lawn dart and thus injured.

Several attempts have been made to provide the darts with flexible tips in lieu of the metal pointed tips to prevent injury.

For example, patents which are directed to safety lawn darts include U.S. Pat. No. 4,946,172, issued to Wong, entitled "SAFETY DART" and U.S. Pat. No. 5,067,728, issued to Dedbeh, entitled "LAWN DART WITH SAFETY FEATURE," which disclose safety darts with a flexible tip or nose. The Wong patent and the Dedbeh patent also disclose the use of slidable fins on a shaft/handle member.

Another example, U.S. Pat. No. 4,887,822, issued to Tsai, entitled "OUTDOOR GAME DART," discloses a general dart configuration. There is provided an elongated rear end portion which can serve as a handle. The front end weighted head member of the dart is described as being made of impact resistant plastic material. The interior of the head member has a weight placed therein.

A further example, U.S. Pat. No. 5,112,062, issued to Pratt, entitled "SAFETY LAWN DART," discloses a dart configuration similar to the one described by Tsai, however the fins are permitted to slide along the shaft and rotate thereabout.

I have determined that one of the biggest drawbacks with darts is that the fins (which provide aerodynamic stability) are easily damaged. Thereby, as the fins become damaged, the aerodynamic stability of the dart is compromised. As a result, the lawn darts do not accurately traverse the desired flight trajectory path when thrown. Hence, the target may be missed.

Examples of targets for tossing games include U.S. Pat. No. 715,249, issued to Dunbar, entitled "GAME APPARATUS"; U.S. Pat. No. 922,717, issued to Parker, entitled "GAME"; U.S. Pat. No. 1,072,954, issued to Junn, entitled "GAME APPARATUS"; and, U.S. Pat. No. 4,319,755, issued to Orser, Sr., entitled "TOSSING GAME." These patents disclose targets having various pocket configurations for tossing an object therein. The Dunbar patent, the Parker patent and the Junn patent also illustrate rearward elevation of the target pockets.

Another example, U.S. Pat. No. 614,094, issued to Farnum, entitled "GAME APPARATUS," illustrates a tossing game having a target made of cord arranged into a squared mesh configuration.

Other patents in the tossing game art include U.S. Pat. No. 5,098,109, issued to Wayne, entitled "PARACHUTE GAME" and U.S. Pat. No. 5,286,033, also issued to Wayne, entitled "PARACHUTE GAME AND TARGET." The Wayne patents disclose a game which includes a target and a parachute assembly which serves as the tossing object. The parachute assembly is described as having a canopy, a plurality of cords and a body portion. The canopy is described as assisting in retarding the speed of descent.

U.S. Pat. No. 1,350,103, issued to Lehmann, entitled "TOY" discloses a projectile having a barrel which houses an explosive charge and a parachute coupled to a center rod. As described, the parachute serves to retard the descent of the projectile.

While each of the above patents functions as described, none disclose a lawn tossing game which includes a safety hand-tossed projectile having a weighted safety head, a handle member and an airfoil stabilizer chute having a generally opened flattop parachute design slidably coupled to the handle member.

As will be seen more fully below, the present invention is substantially different in structure, methodology and approach from that of the prior tossing games.

SUMMARY OF THE INVENTION

The preferred embodiment of the lawn tossing game of the present invention solves the aforementioned problems in a straight forward and simple manner. In general, the tossing game of the present invention has been predominately designed with safety in mind for all ages. What is provided is a tossing game comprising a safety hand-tossed projectile having a weighted safety head, a handle member projecting from a rear end of said weighted safety head and an airfoil stabilizing chute slidably coupled to said handle member to extend, immediately upon release of said safety hand-tossed projectile, from a forward end of said handle to a rear end of said handle member; and, a target adapted to receive said safety hand-tossed projectile.

In view of the above, an object of the present invention is to provide a safety hand-tossed projectile which has a sufficient weight and aerodynamic stability to allow the safety hand-tossed projectile, when thrown, to accurately traverse a flight trajectory path having a distance of 20 feet to 50 feet.

Another object of the present invention is to provide a safety hand-tossed projectile with an airfoil stabilizer chute having an opened flattop parachute or canopy slidably coupled on the handle member and a plurality of collapsible radial arms radiating from said opened flattop parachute or canopy design and affixed to the base of the weighted safety head of the projectile.

A further object of the present invention to provide such an airfoil stabilizer chute with collapsible radial arms which when collapsed increases the outer perimeter and thus the surface area of the opened flattop parachute or canopy so that air currents acting on the opened flattop parachute or canopy causes the immediate and rapid extension of the opened flattop parachute or canopy to the rear end of the handle member. Thereby, aerodynamic control and steering are immediately had upon release of the safety hand-tossed projectile.

It is a still further object of the present invention to provide an airfoil stabilizer chute which automatically opens upon release of the safety hand-tossed projectile to control the flight and steering of the projectile and to stabilize the trailing handle member along the flight trajectory path to prevent wobbling or spiraling thereof.

It is a still further object of the present invention to provide an airfoil stabilizer chute which does not significantly retard the decent of the safety hand-tossed projectile.

It is a still further object of the present invention to provide an airfoil stabilizer chute having a generally starlike pattern layout.

It is a still further object of the present invention to provide an airfoil stabilizer chute having collapsible radial arms which are uniquely contoured to prevent tangling thereof. Thereby, when the safety hand-tossed projectile is released, the immediate and rapid extension of the airfoil stabilizer chute rearward is had without failure.

It is a still further object of the present invention to provide the safety hand-tossed projectile with a weighted safety head having a conically shaped member made of "olite" (lightweight carpet) or other cushioning material which is resilient and serves to absorb impact energy. Thereby, the weighted safety head of the projectile does not cause injury if a person is accidentally struck.

It is a still further object of the present invention to provide such a weighted safety head which includes a conically shaped member having a rubber or otherwise soft and resilient rounded tip.

It is a still further object of the present invention to provide a multi-pocketed target having a plurality of pockets arranged in a row and column (matrix) configuration.

It is a still further object of present invention to provide a multi-pocketed target which increasingly elevates rearward the rows of pockets.

In view of the above objects, it is a feature of the present invention to provide a tossing game which is simple to use and fun to play.

Another feature of the present invention is to provide a tossing game which is relatively simple structurally and thus easy to manufacture.

The above and other objects and features of the present invention will become apparent from the drawings, the description given herein, and the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein:

FIG. 2*b* illustrates a top view of the preferred embodiment of the safety hand-tossed projectile of the present invention with the collapsible radial arms of the airfoil stabilizer chute in a fully collapsed position;

DESCRIPTION OF THE EXEMPLARY EMBODIMENT

Figures 1, 2A, 3:
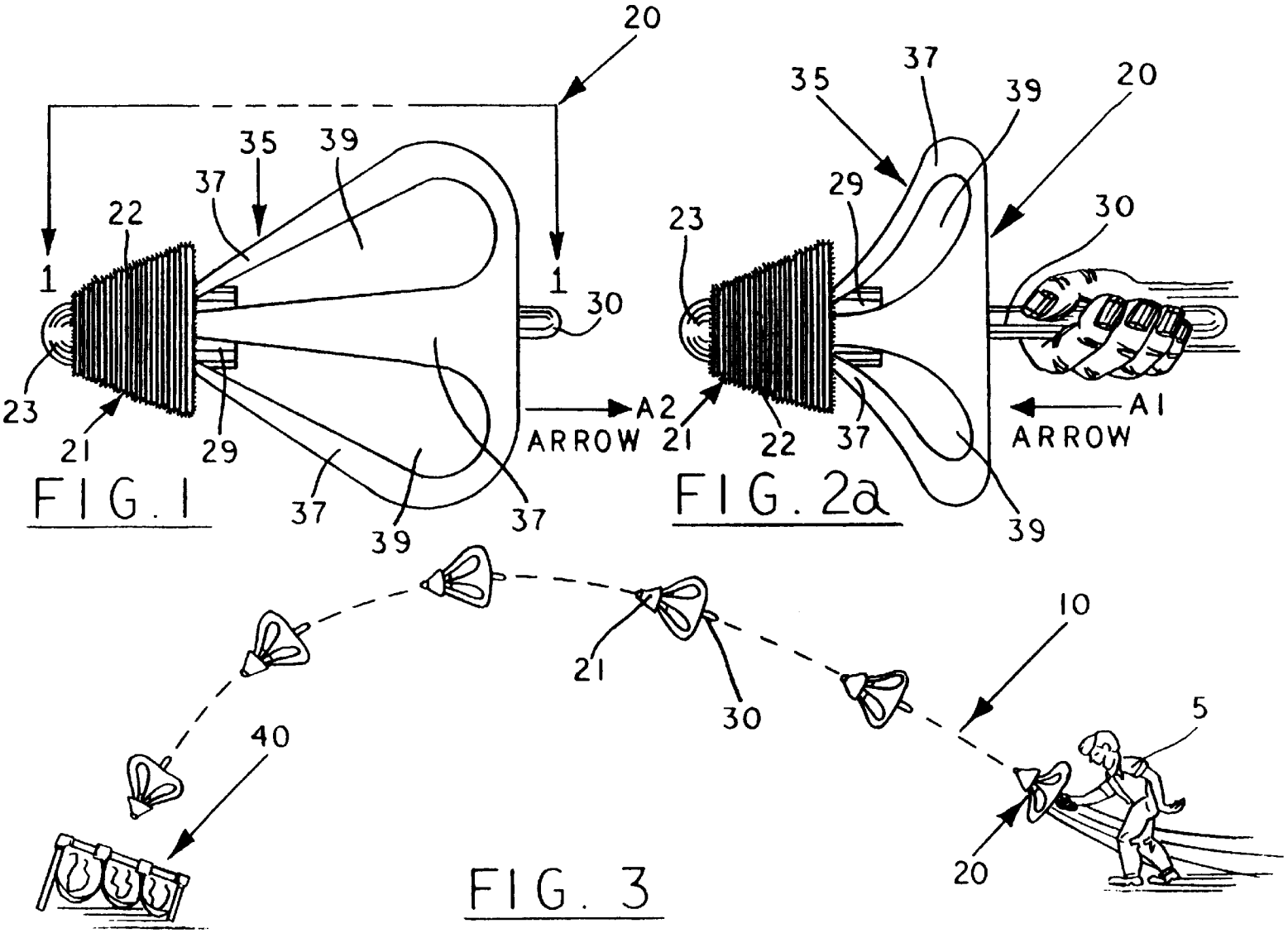
FIG. 1 illustrates a side view of the preferred embodiment of the safety hand-tossed projectile of the present invention with the collapsible radial arms of the airfoil stabilizer chute in the fully extended position.
FIG. 2*a* illustrates a side view of the preferred embodiment of the safety hand-tossed projectile of the present invention with the collapsible radial arms of the airfoil stabilizer chute in a collapsed position.
FIG. 3 illustrates the lawn tossing game of the present invention with the safety hand-tossed projectile in flight to the multi-pocketed target.

Referring now to the drawings, and in particular FIG. 3, the lawn tossing game of the present invention is designated generally by the numeral 10. Lawn tossing game 10 is comprised of at least one safety hand-tossed projectile 20 and at least one multi-pocketed target 40 wherein a safety hand-tossed projectile 20 is adapted to be thrown underhandedly, by player 5, through the air and into multi-pocketed target 40.

For exemplary purposes, only one safety hand-tossed projectile 20 and one multi-pocketed target 40 is shown. Nevertheless, preferably, a plurality of safety hand-tossed projectiles 20 would be provided and color coded for individual teams and/or players 5. Furthermore, two multi-pocketed targets are preferred, each at opposite ends of the playing field.

Referring now to FIGS. 1, 2*a*, 2*b* and 4, safety hand-tossed projectile 20 includes weighted safety head 21, handle member 30 projecting rearwardly from the base of weighted safety head 21 and airfoil stabilizer chute 35 slidably coupled on handle member 30. In the exemplary embodiment, the total longitudinal length of safety hand-tossed projectile 20 is approximately 14 ⅝" (fourteen and five-eights inches).

Weighted safety head 21 comprises conically shaped member 22 having a rubber or otherwise soft and resilient rounded tip 23 and weight member 24 embedded in conically shaped member 22. Conically shaped member 22 has formed along the center axis thereof a central bore 25. Central bore 25 has journalled therein a portion of handle member 30. In the exemplary embodiment, weighted safety head 21 is approximately 4 ⅝ inches (four and five-eights inches).

Handle member 30 has a predetermined length which enables the player to grasp handle member 30 and throw safety hand-tossed projectile 20. One end of handle member 30 is journalled and secured, such as, without limitation, by glue, in central bore 25. Such end has affixed thereto weight member 24 via screw 24*a*. Thereby, weight member 24 is positioned in the forward end of bore 25. In the preferred embodiment, handle member 30 is constructed of a ⅝" diameter wooden dowel stock which provides a virtually unbreakable and safe hand gripping mechanism. The length of handle member 30 is approximately 10" (ten inches) when measured rearward of the base of weighted safety head 21 and has a total length of approximately 12" (twelve inches). The rearward length of handle member 30 assists in the aerodynamic stability of safety hand-tossed projectile 20.

In the exemplary embodiment, conically shaped member 22 is made of graduated-sized discs of "olite" (lightweight carpet). In the exemplary embodiment, the graduated-sized discs are paired. Two adjacent discs have the same diameter to form a pair of discs 26. The first pair of discs 26*a* positioned at the forward end has a diameter of approximately 2" (two inches) and the last pair of discs 26*b* positioned at the rear end or the base of conically shaped member 22 has a diameter of approximately 4 ½" (four and one-half inches). The graduated-sized pairs of discs create a stepwise configuration which serves to enhance the flight of projectile 20.

The "olite" (lightweight carpet) is resilient and serves to absorb impact energy so that the weighted end of projectile 20 does not cause injury if a person is accidentally struck. In lieu of "olite," conically shaped member 21 may be constructed from any soft cushioning material, such as felt, or flexibly resilient material capable of providing the necessary weight for safety weighted head 21 and additionally absorbs impact energy. While it is preferred that conically shaped member 20 is made of soft cushioning material, if desired a rigid material such as hard plastic or the like, can be substituted. Furthermore, conically shaped member 21 can be constructed as a solid piece of resilient material in lieu of the graduated discs.

In the exemplary embodiment, each of the discs of the disc pairs 26 have been bonded together with cement glue or the like. However, the periphery of each disc is not bonded since such bonding would render conically shaped member 21 rigid. Furthermore, the first four disc pairs 26 do not have center holes formed therein and thus are solid. However, the remaining disc pairs have center holes formed therein and such discs have been bonded with cement glue or the like to handle member 30.

There is a predetermined weight ratio between the weight of weighted safety head 21 and handle member 30 so that, as safety hand-tossed projectile 20 begins to descend along the flight trajectory path, the nose end (rounded tip 23) of weighted safety head 21 automatically orients to point angularly downward, as best seen in FIG. 3. This angularly downward flight trajectory path allows safety hand-tossed projectile 20 to be directed into my multi-pocketed target 40. Nevertheless, as safety hand-tossed projectile 20 ascends along the flight trajectory path, the predetermined weight ratio between the weight of weighted safety head 21 and handle member 30 orients handle member 30 rearward and trailing weighted safety head 21, as best seen in FIG. 3.

I have determined that the predetermined weight ratio between the weight of weighted safety head 21 and handle member 30 is approximately three-to-one. In other words, weighted safety head 21 is three times heavier than handle member 30. The weight balance point of weighted safety head 21 is approximately 3 3/16" (three and three-sixteenths inches) from the nose end (rounded tip 23). As can be appreciated, since the weight of the material of weighted safety head 21 will vary, the actual weight of weight member 30 may be selected to additionally compensate for the weight variations between weighted safety head 21 and handle member 30.

Figure 5:
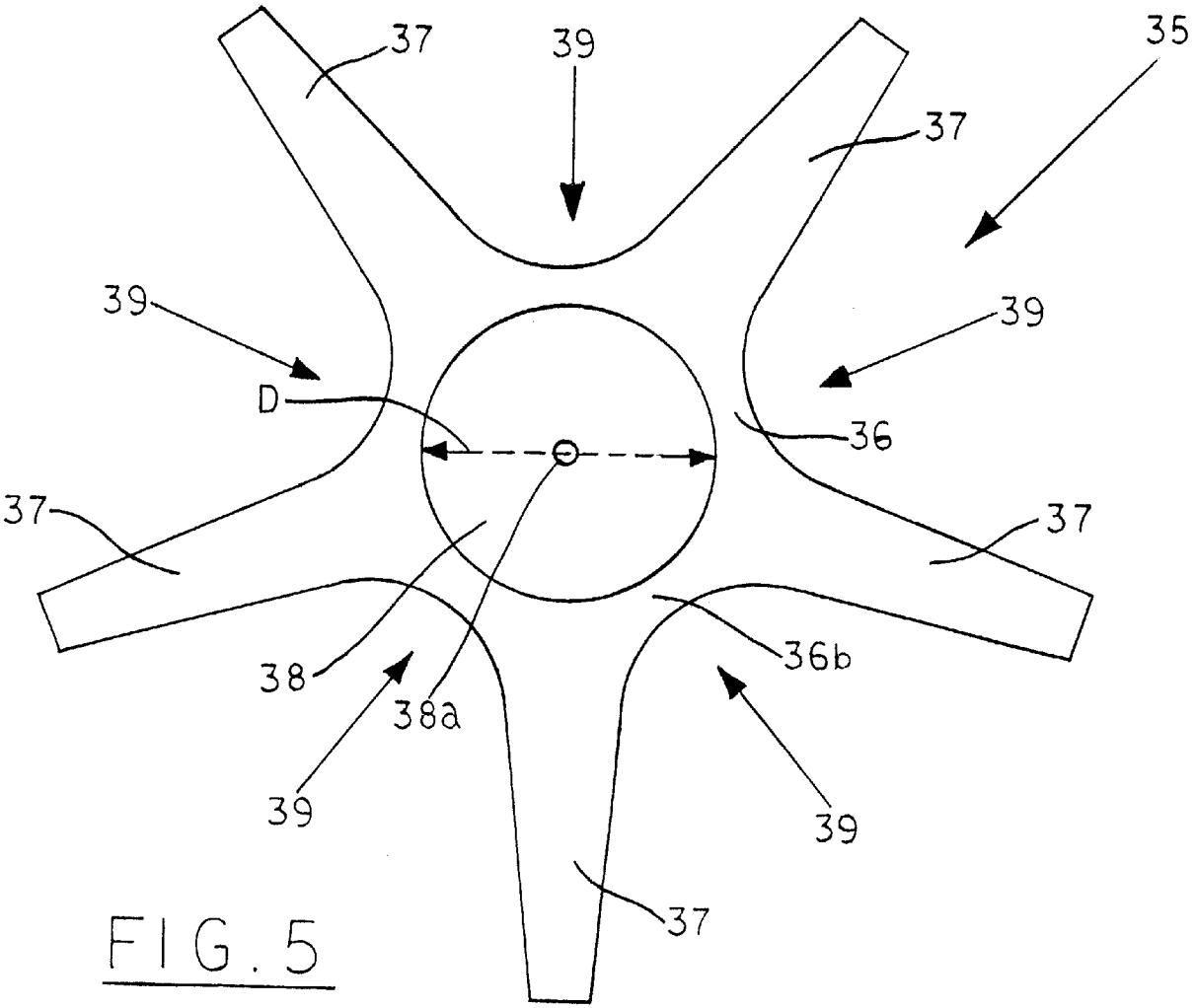
FIG. 5 illustrates a pattern layout of the airfoil stabilizer chute of the present invention.

Referring also to FIG. 5, airfoil stabilizer chute 35 has a starlike pattern layout wherein such starlike pattern layout has five (5) points which have been truncated. Nevertheless, airfoil stabilizer chute 35 may have any number of points with certain limits discussed below.

Airfoil stabilizer chute 35 comprises central body 36 having a centrally located aperture 36*a* formed therein, a plurality collapsible radial arms 37 radiating from central body 36 and a central disc member 38 having a predetermined diameter D. Central disc member 38 has a centrally located aperture 38*a* formed therein wherein the center of centrally located aperture 36*a* and centrally located aperture 38*a* are aligned.

Central disc member 38 is affixed to central body 36 and provides structural support to central body 36 to create a generally non-collapsible opened flattop parachute or canopy, as best seen in FIGS. 1–4. Margin 36*b* of central body 36 is that region of central body 36 beyond the circumferential outer perimeter edge of central disc member 38. In the exemplary embodiment, airfoil stabilizer chute 35 is made of a lightweight and dense material, such as, without limitation, felt, so that air does not permeate therethrough. Central disc member 38 is also made of such lightweight and dense material, such as, without limitation, felt, but can be made of a somewhat rigid material. In the preferred embodiment, the predetermined diameter D of central disc member 38 is approximately 6 ½" (six and one-half inches) The width of margin 36*b* varies because of the starlike contour. However, for this pattern layout, the minimum width of margin 36*b* is approximately 1 ¼" (one and one-fourth inches).

The opened flattop canopy or parachute of airfoil stabilizer chute 35 is slidably coupled on handle member 30 via apertures 36*a* and 38*a*. The free ends of radial arms 37 are affixed to the base of weighted safety head 21. Weighted safety head 21 further includes rear retainer member 29 which has coupled therethrough handle member 30. One end of rear retainer member 29 is affixed to the base of weighted safety head 21 and sandwiches therebetween the free ends of radial arms 37. In the exemplary embodiment, rear retainer member 29 is made of a lightweight foamed plastic or the like. Rear retainer member 29 has a length of approximately 1 ½" (one and one-half inches).

Collapsible radial arms 37 are defined by the five truncated points which taper in width to the free ends thereof. The spacing between any two adjacent collapsible radial arms 37 defines concaved segment 39 to create a high-arched air gap when the opened flattop parachute or canopy is in the extended position. Any increase in the number of radial arms 37 narrows concaved segments 39 and thus reduces the flow of air currents therethrough. Therefore, the maximum number of radial arms is limited to a number which does not significantly narrow the high-arched air gap and thus compromise the flow of air currents through concaved segments 39. As can be appreciated, a narrow air gap (concaved segment 39) between adjacent collapsible radial arms 37 would obstruct the flow of air currents therethrough and thus the immediate and rapid extension of airfoil stabilizer chute 35 toward the rear of handle member 30.

Figure 4:
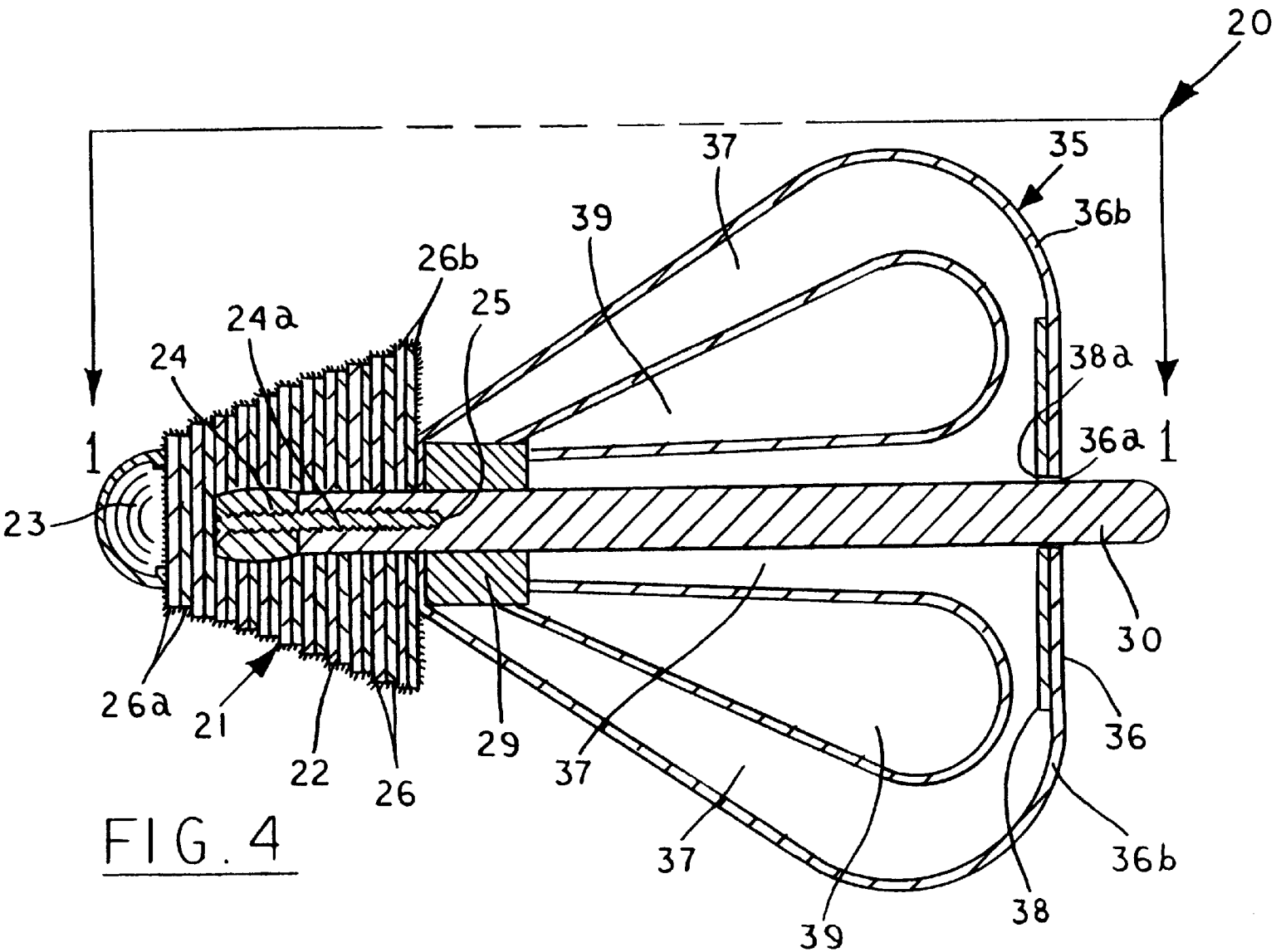
FIG. 4 illustrates a cross-sectional view along the plane 1—1 of FIG. 1.

The collapsible property of radial arms 37 allows the opened flattop parachute or opened flattop canopy to be slid from the rear end, as shown in FIG. 1 and 4, to the front end of handle member 30 to provide an unobstructed gripping surface for the placement of the hand of player 5 (FIG. 3) around handle member 30. As radial arms 37 are collapsed, the contour of the opened flattop canopy flares because of the loose profile of radial arms 37.

As can be appreciated, the slidable property of the opened flattop parachute or opened flattop canopy permits easier access to grip handle member 30, when throwing, while allowing the opened flattop parachute or opened flattop canopy to automatically orient itself rearwardly upon release.

Airfoil stabilizer chute 35 does not use strings or cords because strings or cords tend to become tangled in the collapsed position. I have determined that the tapered contour of collapsible radial arms 37 prevents tangling when in the collapsed position. Henceforth, airfoil stabilizer chute 35 will always extend to the rear end of handle member 30 without failure.

The opened flattop parachute or canopy is structured to allow the opened flattop parachute or canopy, when pressure is applied thereto in the direction of Arrow A2, as best seen in FIG. 1, to maintain its opened flattop contour and be easily slid forwardly along handle member 30 to collapse radial arms 37, as best seen in FIGS. 2*a* and 2*b*.

As can be readily seen in FIG. 2*b*, when collapsible radial arms 37 are collapsed, margin 36*b* of central body 36 is free to radially extend (flare) from the circumferential outer perimeter edge of central disc member 38. Thus the surface area of the opened flattop parachute or canopy is slightly increased by the width of margin 36*b* and has the general contour of central body 36. Therefore, the surface area of the opened flattop parachute or canopy is maintained and is slightly increased when the collapsible radial arms 37 are collapsed.

Therefore, when safety hand-tossed projectile 20 is underhandedly tossed, the air currents acting on the surface area of the opened flattop parachute or canopy causes the immediate and rapid extension of the opened flattop parachute or canopy to the rear end of handle member 30, in the direction of Arrow A2. Thereby, aerodynamic control and steering are immediately had upon release of the safety hand-tossed projectile 20.

The opened flattop parachute or canopy immediately and rapidly slides rearwardly, in the direction of Arrow A2, along handle member 30 until radial arms 37 become taut (extended) under the force of the air currents. As radial arms 37 become taut, margin 36*b* of central body 36 defined beyond the circumferential outer perimeter edge of central disc member 38 curves downward around such edge. However, the surface area defined by cental disc member 38 maintains a generally flat profile defining the opened flattop parachute or canopy.

Airfoil stabilizer chute 35 provides a resistance force to stabilize handle member 30 such that handle member 30 does not wobble or spiral. The unique design of airfoil stabilizer chute 35 when extended rearwardly along handle member 30, provides aerodynamic stabilizing and steering to control the flight of safety hand-tossed projectile 20 along the desired flight trajectory path. Furthermore, airfoil stabilizer chute 35 assists in maintaining handle member 30 trailing weighted safety head 21 along the flight trajectory path.

My airfoil stabilizer chute 35 eliminates the need for fins or other permanent structures which have been used to provide aerodynamic stability.

The overall weight of weighted safety head 21 and handle member 30 provides for a downward velocity during the decent of safety hand-tossed projectile 20 which is not significantly retarded by airfoil stabilizer chute 35. While the provision of airfoil stabilizer chute 35 provides a resistance force to aerodynamically stabilize safety hand-tossed projectile 20, such resistance force does not significantly retard the decent of safety hand-tossed projectile 20 into multi-pocketed target 40 by any noticeable amount.

Referring also to FIGS. 6*a*, 6*b*, 6*c*, and 7–9, multi-pocketed target 40 comprises matrix frame 41 arranged in a row and column (matrix) configuration and a plurality of pockets 45*a*, 45*b*, 45*c*, 5*d*, 45*e*, 45*f*, 45*g*, 45*h* and 45*i* draped from matrix frame 41. In the preferred embodiment, there are three rows, three columns creating nine (9) pockets.

Figure 6C:
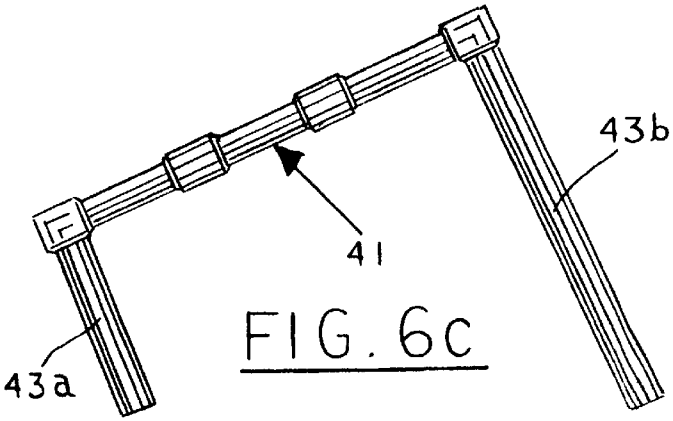
FIG. 6*c* illustrates a side view of the frame of the multi-pocketed target of the present invention.
Figure 6A:
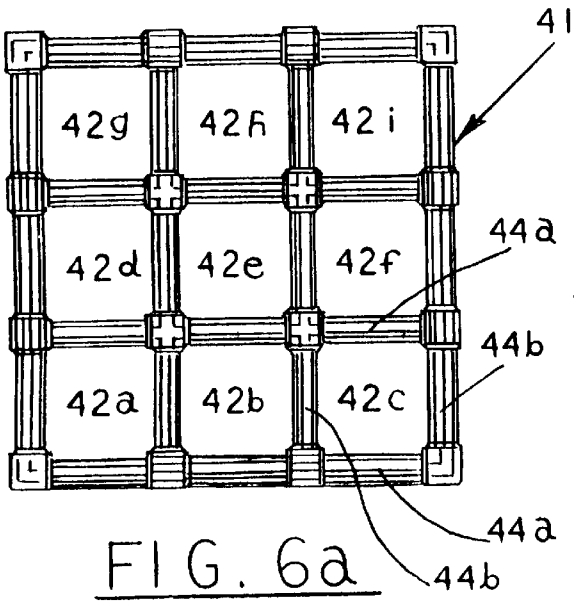
FIG. 6*a* illustrates a top view of the frame of the multi-pocketed target of the present invention.
Figure 6B:
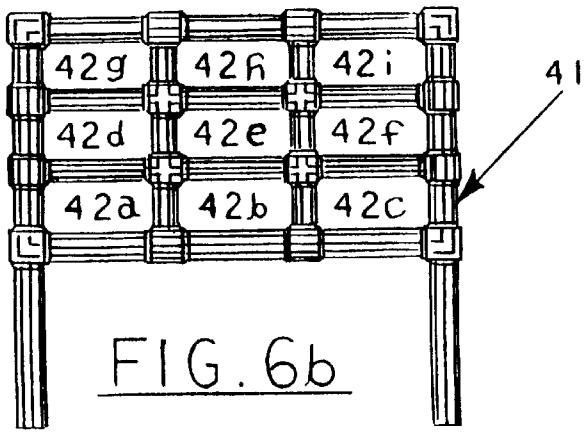
FIG. 6*b* illustrates a front view of the frame of the multi-pocketed target of the present invention.

Matrix frame 41 defines a plurality square pocket orifices 42*a*, 42*b*, 42*c*, 42*d*, 42*e*, 42*f*, 42*g*, 42*h* and 42*i*. In the preferred embodiment, a distance between any two opposing corners of each square pocket orifice is slightly greater than a total longitudinal length of safety hand-tossed projectile 20. Nevertheless, this distance may be decreased, as desired. As best seen in FIG. 6*a* and 6*b*, the plurality of square pocket orifices 42*a*, 42*b*, 42*c*, 42*d*, 42*e*, 42*f*, 42*g*, 42*h* and 42*i* are arranged in the row and column configuration. Since each square pocket orifice is identical, only one such square pocket orifice will be described in detail. Square pocket orifice 42*c* comprises two parallel row bars 44*b* and two parallel column bars 44*a* coupled together to form a square.

As best seen in FIG. 6*a*, matrix frame 41 has a generally square perimeter shape. The diameter of the bars 44*a* and 44*b* defining the generally square perimeter shape is larger than the diameter of the remaining bars 44*a* and 44*b* of the square pocket orifices 42*b*, 42*e*, 42*h* defining the interior matrix configuration. Since the bars 44*a* and 44*b* in the interior have a smaller diameter, there is easier access into the pockets 45*a*, 45*b*, 45*c*, 45*d*, 45*e*, 45*f*, 45*g*, 45*h* and 45*i*. For example, the bars 44*a* and 44*b* of the square perimeter have a diameter of ¾" (three-fourths inches) and the bars 44*a* and 44*b* of the interior matrix configuration have a diameter of ½" (one-half inches). Nevertheless, the bars 44*a* and 44*b* of the interior matrix configuration may be of any reduced size provided such bars are strong and maintain their structural integrity.

A respective one of the bars 44*a* is removably coupled to a respective one of the bars 44*b* via a joint member. Thereby, each piece of the matrix frame 41 is easily assembled and disassembled. However, once assembled only the legs need to be taken apart.

Multi-pocketed target 40 further includes front legs 43*a* coupled to the front corners of matrix frame 41 and rear legs 43*b* coupled to the rear corners of matrix frame 41. In the preferred embodiment, rear legs 43*b* are longer than front legs 43*a* to elevate rearwardly matrix frame 41. Preferably, front legs 43*a* and rear legs 43*b* are removably coupled to matrix frame 41 so that target 40 can be easily disassembled for transportability. In the exemplary embodiment, front legs 43*a* and rear legs 43*b* are angled rearwardly from the front and rear corners of matrix frame 41. However, front legs 43*a* and rear legs 43*b* are angled approximately 90° (ninety degrees) from matrix frame 41.

Pockets 45*a*, 45*b*, 45*c*, 45*d*, 45*e*, 45*f*, 45*g*, 45*h* and 45*i* are draped from a respective square pocket orifice. Pockets 45*a*, 45*b*, 45*c*, 45*d*, 45*e*, 45*f*, 45*g*, 45*h* and 45*i* comprise a plurality of row strips of material 46*a*, 46*b* and 46*c* and a plurality of column strips of material 47*a*, 47*b* and 47*c* which crisscrosses the plurality of row strips of material 46*a*, 46*b* and 46*c*.

Figure 8:
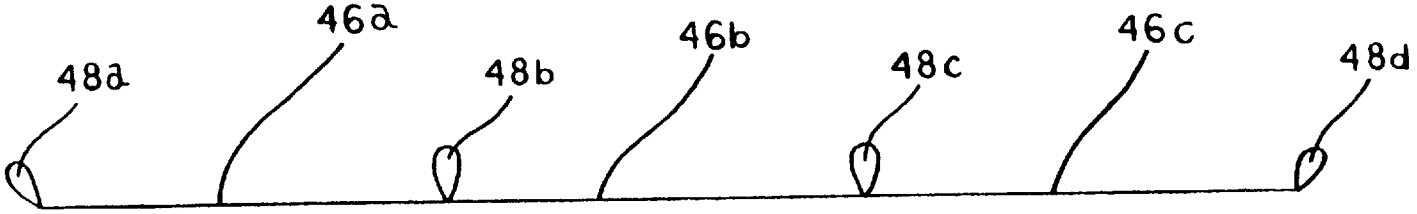
FIG. 8 illustrates an end view of the material strip forming the pockets; and, FIG. 9 illustrates a side view of the pockets.

The plurality of row strips of material 46*a*, 46*b* and 46*c* and the plurality of column strips of material 47*a*, 47*b* and 47*c* are essentially identical strips of material. As shown in FIG. 8, an exemplary strip of material 46*a* is illustrated. The strip of material 46*a* has formed therein a plurality of spaced channels 48*a*, 48*b*, 48*c* and 48*d* which receive therein the row bars 44*a* or the column bars 44*b* defining the square pocket orifices of a row or a column, respectively.

Figure 7:
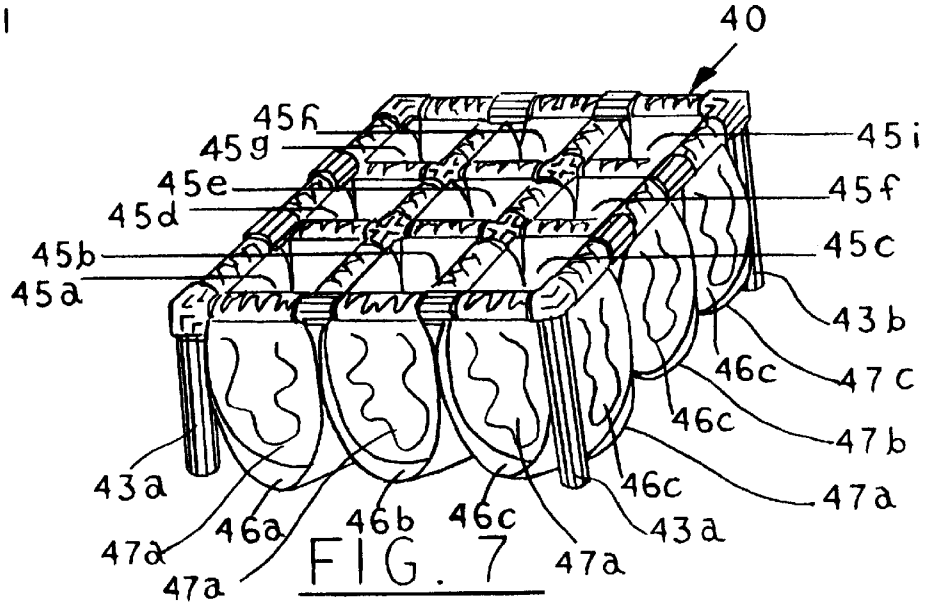
FIG. 7 illustrates a perspective view of the multi-pocketed target of the present invention.
Figure 9:
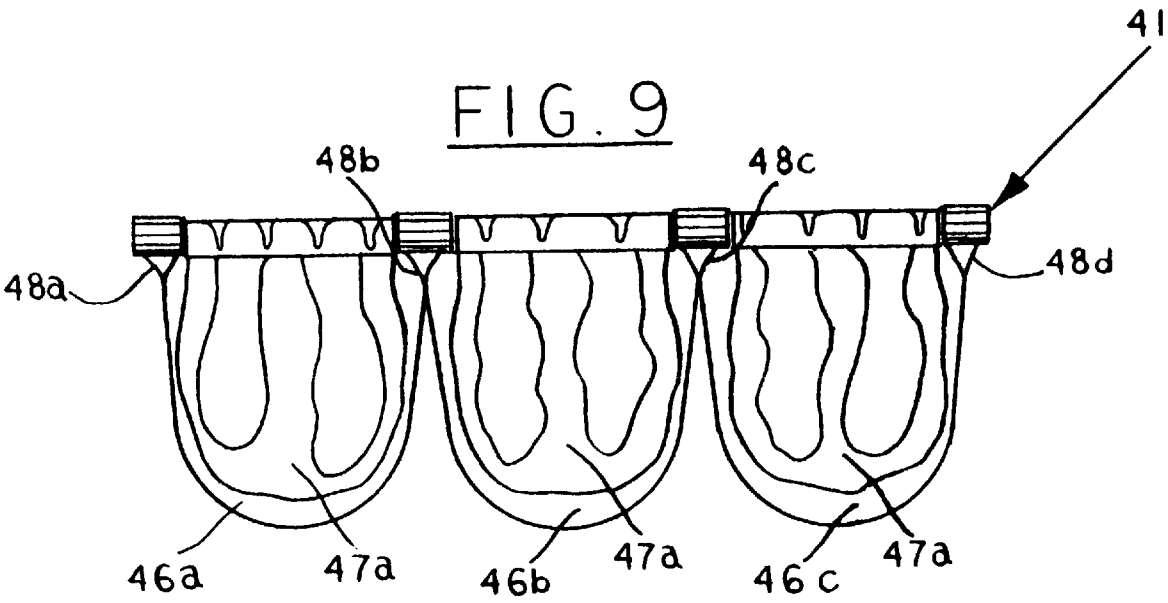

A respective row strip of material 46*a*, 46*b* or 46*c* is draped from the parallel row bars 44*a* spaced along a respective row. Likewise, a respective column strip of material 47*a*, 47*b* or 47*c* is draped from the parallel column bars 44*a* spaced along a respective column, as best seen in FIG. 7. A respective column strip of material 47*a*, 47*b* or 47*c* crisscrosses a portion of the plurality of row strips of material 46*a*, 46*b* and 46*c*, as can be seen in FIGS. 7 and 9.

The design of my pockets 45*a*, 45*b*, 45*c*, 45*d*, 45*e*, 45*f*, 45*g*, 45*h* and 45*i* and the design my safety hand-tossed projectile 20 allow each of the pockets 45*a*, 45*b*, 45*c*, 45*d*, 45*e*, 45*f*, 45*g*, 45*h* and 45*i* to receive therein more than one safety hand-tossed projectile 20. For example, three (3) to five (5) safety hand-tossed projectiles 20 may be stacked in a respective one of pockets 45*a*, 45*b*, 45*c*, 45*d*, 45*e*, 45*f*, 45*g*, 45*h* and 45*i* for each play or turn, as lawn tossing game 10 is played. This feature allows my lawn tossing game 10 to be easily scored as will be discussed later.

More specifically, the depth of my pockets 45*a*, 45*b*, 45*c*, 45*d*, 45*e*, 45*f*, 45*g*, 45*h* and 45*i* and the length of my safety hand-tossed projectile 20 are substantially equal. Thereby, when safety hand-tossed projectile 20 is thrown in a respective one of the pockets 45*a*, 45*b*, 45*c*, 45*d*, 45*e*, 45*f*, 45*g*, 45*h* and 45*i* and the nose end (resilient rounded tip 23) is oriented downward, the force of gravity slides airfoil stabilizer chute 35 along handle member 30 to a collapsed position thereby freeing up space in the pocket to receive another safety hand-tossed projectile 20.

As can be readily seen, the nose end (resilient rounded tip 23) of conically shaped member 22 should be oriented downward in a respective pocket because of the weight distribution of conically shaped member 22. Since the handle member is relatively long and narrow and the ability of airfoil stabilizer chute 35 to collapse under gravitational force, a significant amount of space in a respective one of the pockets 45*a*, 45*b*, 45*c*, 45*d*, 45*e*, 45*f*, 45*g*, 45*h* and 45*i* is left unoccupied. Such unoccupied space is capable of receiving (stacking) additional safety hand-tossed projectiles 20.

The ability of airfoil stabilizer chute 35 to collapse while in the pockets 45*a*, 45*b*, 45*c*, 45*d*, 45*e*, 45*f*, 45*g*, 45*h* and 45*i* prevents the airfoil stabilizer chute 35 from becoming damaged as the projectiles 20 are stacked in a respective pocket. Thereby, the aerodynamic stability of safety hand-tossed projectile 20 is not compromised.

The following description will describe the general scoring method of lawn tossing game 10. Preferably, the center pocket 45*e* generates 3 points and all other pockets 45*a*, 45*b*, 45*c*, 45*d*, 45*f*, 45*g*, 45*h* and 45*i* generate 1 point. Nevertheless, the pockets 45*a*, 45*b*, 45*c*, 45*d*, 45*e*, 45*f*, 45*g*, 45*h* and 45*i* may have any point designation. The following list of rules apply when a player throws more than one safety hand-tossed projectile 20 during their turn:

1) The highest score rule: the highest score for a play cancels all other scores. Thereby, only the player with the highest score of a play receives any points for a given play. The player's score for a play is determined by adding the points for each of the safety hand-tossed projectiles 20 thrown by such player.
2) The cancel rule: if a projectile 20 of the player with the highest score and a projectile 20 of the opponent with the next highest score have the same point(s), such points are canceled. For example, if the highest scorer throws two three's (3+3=6 points) and an opponent with the next highest score throws a three and a one (3 +1=4 points) then the score for the player with highest score is reduced to 3. All other players receive no points.
3) The throwing order rule: the player with the lowest accumulated score at any point in the game always determines the order in which the other players throw in the next play.
4) The winner rule: the winner of the game is the first player who reaches a predetermined number of points.
5) The penalty rule: if the player with the highest score, as determined by the highest score rule above, needs X points to go out and scores more than X points in the play, then the accumulated score of the player is reduced by the player's points for the play. Note, the player's score for a play is determined by the highest score rule and the cancel rule.

In general, when playing lawn tossing game 10, two multi-pocketed targets 40 (only one shown in FIG. 3) would be placed at opposite ends of a playing field. Thereafter, the players 5 would take turns throwing their projectiles 20. The points would be accumulated in accordance with the rules set forth above.

An example of how the scoring is calculated according to the penalty rule will be described below. If the predetermined number of points needed to win the game is 21 and the highest scorer for a play has accumulated 20 points, then such player's points for the play must not exceed 1. If the player's points exceeds 1 as determined by the highest score rule and the cancel rule, than the player's accumulated score is reduced by the points of the play. Thereby, the penalty rule makes it difficult for players to go out.

While the lawn tossing game 10 is preferably played outdoors, my lawn tossing game 10 may be played indoors as well.

Lawn tossing game 10 may be further provided with a chalkboard or scoring sheet to allow the players to keep score.

It is noted that the embodiment of the lawn tossing game described herein in detail, for exemplary purposes, is of course subject to many different variations in size, structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A tossing game comprising:

safety hand-tossed projectile having a weighted safety head, a handle member projecting from a rear end of said weighted safety head and an airfoil stabilizing chute slidably coupled to said handle member to extend, from a generally collapsed to a generally opened position immediately upon release of said safety hand-tossed projectile, from a forward end of said handle member to a rear end of said handle member; and, a target adapted to receive said safety hand-tossed projectile.

2. The tossing game of claim 1, wherein said weighted safety head comprises:

a conically shaped member having a rubber or soft and resilient rounded tip; and, a bore formed along a center axis of said conically shaped member having a portion of said handle member affixed therein.

3. The tossing game of claim 2, wherein said conically shaped member is made of graduated-sized pairs of discs of resilient material capable of absorbing impact energy.

4. The tossing game of claim 3, wherein said resilient material is "olite" lightweight carpet.

5. The tossing game of claim 2, wherein said weighted safety head further comprises a weight member embedded in a forward end of said bore and said weighted safety head is approximately three times heavier then said handle member.

6. The tossing game of claim 1, wherein said airfoil stabilizer chute comprises:

a central body having a centrally located aperture formed therein;

a plurality of spaced collapsible radial arms radiating from said central body wherein free ends of said plurality of spaced collapsible radial arms are coupled to said rear end of said weighted safety head; and, a central disc member overlaid on said central body defining an opened flattop parachute or canopy having a predetermined diameter and a centrally located aperture formed therein wherein the center of said centrally located aperture of the central disc member and said centrally located aperture of the central body are aligned.

7. The tossing game of claim 6, wherein said weighted safety head comprises:

a conically shaped member having a rubber or soft and resilient rounded tip and a base defining said rear end of said weighted safety head wherein said base has a base diameter; and, wherein said diameter of said central disc member is greater than said base diameter.

8. The tossing game of claim 1, wherein said airfoil stabilizing chute has a starlike pattern layout.

9. The tossing game of claim 1, wherein said target comprises a plurality of pockets arranged in a matrix configuration.

10. The tossing game of claim 9, wherein each pocket of said plurality of pockets has a square orifice and wherein a distance between any two opposing corners of said square orifice is slightly greater than a total longitudinal length of said safety hand-tossed projectile.

11. The tossing game of claim 9, wherein each pocket has a depth approximately equal to the total length of said safety hand-tossed projectile.

12. The tossing game of claim 1, wherein said target comprises:

a frame having a plurality of square orifices arranged in a row and column configuration;

front legs coupled to front corners of said frame;

rear legs coupled to rear corners of said frame wherein said rear legs are longer than said front legs to elevate rearwardly said frame; and pockets draped from each square orifice of said plurality of square orifices.

13. The tossing game of claim 12, wherein said front and rear legs are removably coupled to said frame.

14. The tossing game of claim 12, wherein each square orifice comprises two parallel row bars and two parallel column bars; and wherein said pockets comprise:

a plurality of row strips of material wherein a respective row strip of material is draped from said parallel row bars spaced along a respective row; and, a plurality of column strips of material wherein a respective column strip of material is draped from said parallel column bars spaced along a respective column wherein said respective column strip crisscrosses a portion of said plurality of row strips of material.

15. The tossing game of claim 1, further comprising a second target at an opposite end of a playing field and a plurality of safety hand-tossed projectiles.

16. The tossing game of claim 1, wherein said target comprises:

a frame having a plurality of square orifices arranged in a row and column configuration;

front legs coupled to front coner of said frame;

rear legs coupled to rear coner of said frame; and, a plurality of pockets draped from each square orifice of said plurality of square orifices.

17. The tossing game of claim 16, wherein each pocket of said plurality of pockets has a square orifice and wherein a distance between any two opposing corners of said square orifice is slightly greater than a total longitudinal length of said hand-tossed projectile.

18. The tossing game of claim 17, wherein each pocket has a depth approximately equal to the total length of said safety hand-tossed projectile.

19. The tossing game of claim 17, wherein said depth and said distance are approximately 14⅝".

20. The tossing game of claim 16, wherein said rear legs are longer than said front legs to elevate rearwardly said frame.

21. The tossing game of claim 20, wherein said front and rear legs are removably coupled to said frame.

22. The tossing game of claim 16, wherein each square orifice comprises two parallel row bars and two parallel column bars; and wherein said pockets comprise:

a plurality of row strips of material wherein a respective row strip of material is draped from said parallel row bars spaced along a respective row; and, a plurality of column strips of material wherein a respective column strip of material is draped from said parallel column bars spaced along a column wherein said respective column strip crisscrosses a portion of said plurality of row strips of material.

23. The tossing game of claim 22, wherein said two parallel row bars are detachably coupled to said two parallel column bars.

24. A tossing game comprising:

a safety hand-tossed projectile comprising:

a weighted safety head having a base, a handle member projecting rearward from said base of said weighted safety head, and an opened flattop parachute slidably coupled to said handle member; and a target adapted to receive said safety hand-tossed projectile.

25. The tossing game of claim 24, wherein said opened flattop parachute is extendable rearwardly along said handle member upon release of said safety hand-tossed projectile.

26. The tossing game of claim 24, wherein said weighted safety head comprises:

a conically shaped member having a rubber or soft and resilient rounded tip; and, a bore formed along a center axis of said conically shaped member.

27. The tossing game of claim 26, wherein said weighted safety head further comprises a weight member embedded in a forward end of said bore and wherein said weighted safety head is approximately three times heavier then said handle member.

28. The tossing game of claim 26, wherein said conically shaped member is made of graduated-sized pairs of discs of resilient material capable of absorbing impact energy.

29. The tossing game of claim 26, wherein said resilient material is "olite" lightweight carpet.

30. The tossing game of claim 24, wherein said opened flattop parachute comprises:

a central body having a centrally located aperture formed therein;

a plurality of spaced collapsible radial arms radiating from said central body wherein free ends of said plurality of spaced collapsible radial arms are coupled to said base of said weighted safety head; and, a central disc member coupled to said central body defining an opened flattop parachute contour having a predetermined diameter and a centrally located aperture formed therein wherein a center of said centrally located aperture of the central disc member and said centrally located aperture of the central body are aligned.

31. The tossing game of claim 30, wherein said weighted safety head comprises:

a conically shaped member having a rubber or soft and resilient rounded tip and said base defining said rear end of said weighted safety head wherein said base has a base diameter; and, wherein said diameter of said central disc member is greater than said base diameter.

32. The tossing game of claim 24, wherein said opened flattop canopy has a starlike pattern layout.

* * * * *